United States Patent [19]

Heyning et al.

[11] 4,110,750

[45] Aug. 29, 1978

[54] PROGRAMMABLE ELECTRONIC DOOR CHIME

[75] Inventors: Bjorn Heyning, Saint Joseph, Mich.; Dennis D. Tremblay, La Salle, Ill.

[73] Assignee: Heath Company, Benton Harbor, Mich.

[21] Appl. No.: 728,807

[22] Filed: Oct. 1, 1976

[51] Int. Cl.[2] ..... G08B 3/00

[52] U.S. Cl. ..... 340/384 E; 340/384 R; 84/1.01

[58] Field of Search ..... 340/384 R, 384 E; 84/1.01, 1.03, 1.11, 1.19

[56] References Cited

U.S. PATENT DOCUMENTS

| | | | |
|---|---|---|---|
| 3,693,110 | 9/1972 | Briggs | 340/384 E |
| 3,744,022 | 7/1973 | Olsen | 340/384 E |
| 3,878,750 | 4/1975 | Kapps | 84/1.01 |
| 3,941,024 | 3/1976 | Brand | 84/1.01 |
| 3,999,458 | 12/1976 | Suzuki | 84/1.01 |

*Primary Examiner*—Harold I. Pitts

*Attorney, Agent, or Firm*—William R. Sherman; J. J. Kaliko

[57] ABSTRACT

A programmable electronic door chime is disclosed. The door chime includes programming means to select any desired sequence of notes up to a given maximum which are sounded after momentarily closing a normally open push-button switch. The note sequence is truncated when a different normally open push-button switch is momentarily closed so that the particular switch actuating the chimes may be identified by the length of the note sequence. Tone adjustments are provided to vary the frequency, duration and beat of each note to produce a pleasing sound.

8 Claims, 1 Drawing Figure

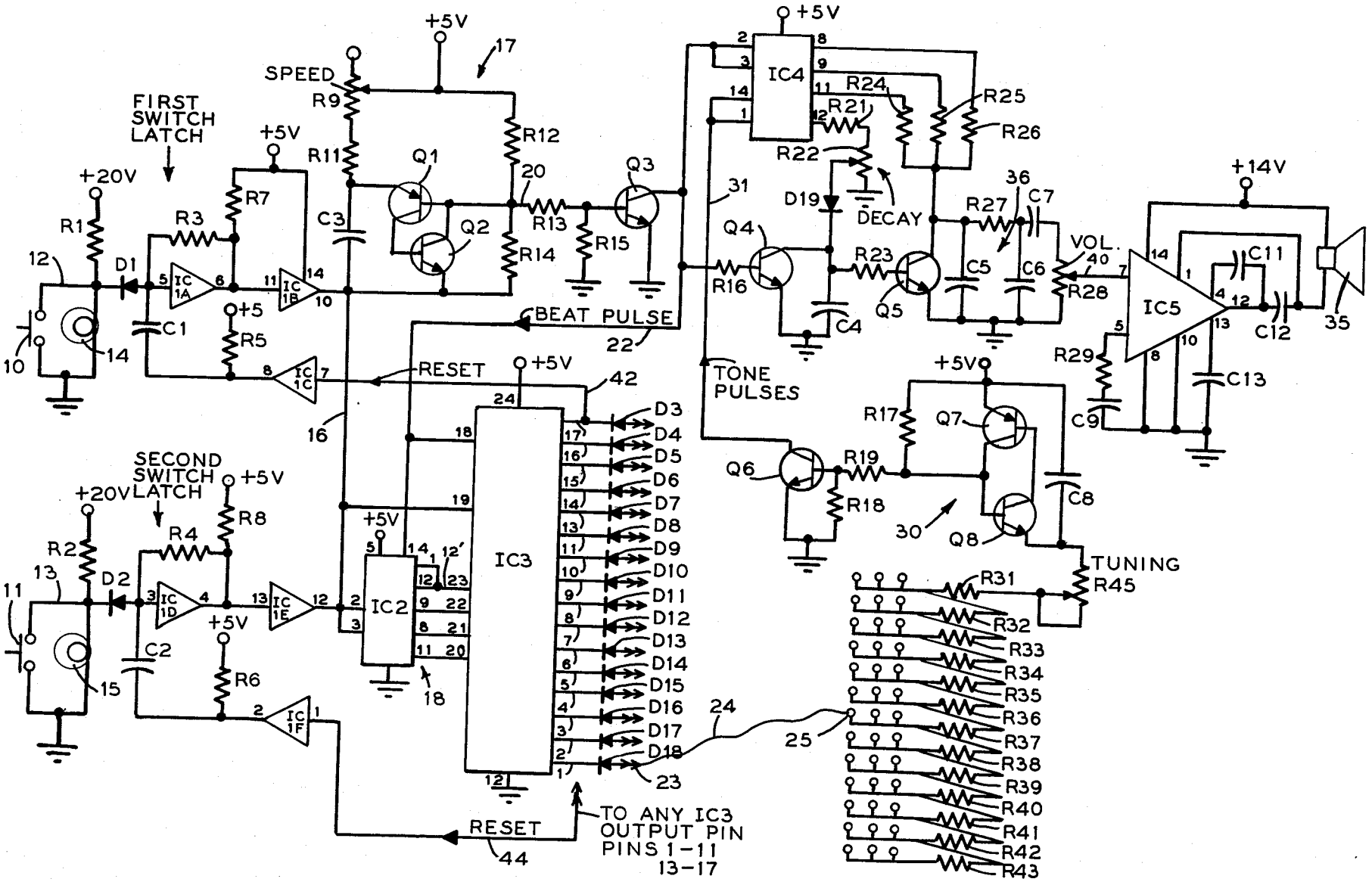
+14V
35
C11
C12
C13
IC5
VOL.
40
R28
R29
C9
C8
TUNING
R45
C7
36
C6
R27
C5
R25
R26
R24
R21
R22
DECAY
D19
R23
C4
Q5
Q4
R16
TONE PULSES
Q7
Q8
30
R17
R19
R18
Q6
R31
R32
R33
R34
R35
R36
R37
R38
R39
R40
R41
R42
R43
25
24
23
TO ANY IC3 OUTPUT PIN PINS 1-11 13-17
IC4
+5V
31
Q3
R15
BEAT PULSE
22
42
D3
D4
D5
D6
D7
D8
D9
D10
D11
D12
D13
D14
D15
D16
D17
D18
IC3
RESET
44
17
R12
20
R13
R14
Q2
Q1
IC2
18
12'
SPEED
R9
R11
C3
16
IC 1B
IC 1C
IC 1E
IC 1F
R7
R5
R8
R6
FIRST SWITCH LATCH
R3
IC 1A
C1
D1
+20V
R1
14
12
10
SECOND SWITCH LATCH
R4
IC 1D
C2
D2
R2
15
13
11

PROGRAMMABLE ELECTRONIC DOOR CHIME

BACKGROUND OF THE INVENTION

1. Field of the Invention

The invention relates to door chimes and, more particularly, to an electronic door chime having a programmable note sequence.

2. Description of the Prior Art

Electro-mechanical door chimes are especially popular for residential applications. These chimes typically are operated by closing a push-button switch which completes an electrical circuit for actuating an electro-mechanical striker and producing an audible chime.

Many electro-mechanical door chimes currently available include means for causing more than one tone to be sounded each time a door chime actuating switch is closed. A common approach is to cause a first tone to sound upon closing the switch followed by sounding a second tone upon opening the switch.

Other electro-mechanical door chimes include several electro-mechanical strikers and tone bars for producing a multi-note sequence in response to a single closing of an actuating switch. These chimes are adaptable to producing different length tone sequence in response to closing different actuating switches.

These relatively simple door chimes usually produce note sequences of only a few notes each time an actuating switch is closed and opened.

More elaborate arrangements have been developed to provide longer and more complicated note sequences. For example, the electric door chime described in U.S. Pat. No. 2,431,787 employs a motorized switching arrangement for actuating a plurality of chimes according to a prewired sequence. The approach there described, however, is subject to reliability problems commonly found in electro-mechanical devices and becomes increasingly more expensive as the number of notes increases. In addition, it is difficult to change the note sequence should the user desire to do so.

Accordingly, it is an object of the present invention to provide an electronic door chime having a multi-note sequence which is programmable, i.e., can be easily changed to suit user preference.

It is a further object of the invention to provide an electronic door chime which identifies the location of the person seeking entry by playing a programmable multi-note sequence the length of which identifies the location of the closed actuating switch.

It is another object of the invention to provide a programmable electronic door chime having control circuitry to adjust note duration, frequency, and note rate (beat) so that the tune and tonal quality of the chime may be adjusted to please the user.

It is still a further object of the invention to provide an inexpensive, easily programmable electronic door chime of simple design.

SUMMARY OF THE INVENTION

The invention relates to electronic door chimes which may be programmed to produce a desired sequence of notes (tune) whenever the chime is actuated. Tone adjustment circuitry is provided for varying the frequency, duration and beat of each note to produce a sound pleasing to the ear of the listener.

According to the preferred embodiment of the invention the door chime includes at least one chime actuating switch coupled to a latch. Whenever the switch is closed the latch is set to start a beat generator which produces a string of pulses at a selectable rate corresponding to the note rate in the desired programmed tune. Each beat pulse (one for each note in the desired tune) is identified by pulse identifying circuitry. A programmable circuit, coupled to the identity circuitry, responds during successive time periods (each uniquely associated with an identified pulse) to produce a second string of pulses at a frequency related to the musical tone (if any) to be sounded during each period. A tone generator responds to the second string of pulses by producing an audible tone having sinusoidal components at frequencies related to the frequency of the second string of pulses and at adjustable amplitudes.

The resulting combination is an electronic door chime that may easily be programmed to play a desired tune with a tonal quality of the user's preference.

Furthermore, according to the preferred embodiment of the invention, the chimes may be programmed to signal which switch actuated the chime whenever two or more actuating switches are employed. To accomplish this each actuating switch is wired to truncate the programmed note sequence after playing a different number of notes. Thus, although the same tune is always initiated by whichever actuating switch is closed, the number of notes in the tune will vary depending on the switch location to thereby identify the switch causing the tune to be played.

The disclosed door chime features easy programmability, tone adjustability and actuating switch location identification.

Further features of the invention include high reliability and low unit cost both of which result from the electronic nature of the device.

BRIEF DESCRIPTION OF THE DRAWING

The foregoing and other objects, advantages and features of the invention are described below in greater detail in connection with the drawing which forms a part of the original disclosure wherein a detailed circuit diagram of the door chime according to the invention is shown.

DETAILED DESCRIPTION

The illustrated embodiment of the invention in the drawing includes a first normally open switch 10 positioned near a building entrance and a second normally open switch 11 preferably positioned near another building entrance. The switches 10 and 11, upon being actuated (closed), respectively provide a short circuit connection between lines 12, 13 and ground.

For the sake of illustration only the drawing shows optional lamps 14 and 15, powered by +20 volt supply, which may be used to light switches 10 and 11 respectively during hours of darkness. If the actual lamps are not employed resistors R1 and R2 and isolation diodes D1 and D2 may be removed.

The voltage at pin 5 of IC1A is normally maintained at approximately +5 volts by the resistors R3 and R7 which are series connected between pin 5 of IC1A and a +5 volt supply. When the switch is closed, however, the voltage on wire 12 goes to ground potential thereby causing the voltage at pin 5 to go to ground also. The non-inverting buffer IC1A responds to ground potential at its input (pin 5) by lowering the voltage at its output (pin 6) to ground potential. The output ground potential is fed back to the input (pin 5) by lowering the voltage at its output (pin 6) to ground potential. The output ground potential is fed back to the input (pin 5) via R3, so that the voltage at pin 6 will remain at ground potential even after the switch 10 is opened. As such, the non-inverting buffer IC1A in the configuration shown comprises a latch circuit or "latch" which becomes set when the voltage at the output of IC1A is at ground potential.

The door chime of the preferred embodiment of the invention includes a second "latch" comprised of another non-inverting buffer IC1D which responds to closing switch 11. Normally the voltage at pin 3 of IC1D is maintained at about +5 volts by the resistors R4 and R8 which are series connected between pin 3 and the +5 volt supply. When the switch 11 is closed, the voltage at pin 3 falls to ground potential which causes the output (pin 4) of the non-inverting buffer IC1D to fall to ground potential. The ground potential at pin 4 is fed back via resistor R4 to the input (pin 3) of IC1D thereby causing the voltage at the output (pin 4) to remain at ground potential. As such, the non-inverting buffer IC1D configured as shown in the drawing comprises a second latch circuit which is set when the voltage at pin 4 is at ground potential.

The output (pin 6) of the non-inverting buffer IC1A connects to the input (pin 11) of another non-inverting buffer IC1B. The output (pin 4) of the non-inverting buffer IC1D connects to the input (pin 13) of still another non-inverting buffer IC1E. The output of non-inverting buffers IC1B and IC1E are connected together by a line 16 and the voltage thereon is low (ground potential) whenever the input to either IC1B or IC1E is low. Since IC1B and IC1E respond to voltage changes at their respective inputs (pin 11 and pin 13) and are unaffected by voltage changes caused by circuits connected to their respective outputs (pin 10 and pin 12), voltage changes on the line 16 do not affect the latch circuits connected to the respective inputs of IC1B and IC1E.

The door chime of the invention includes a beat generator 17, a pulse counter IC2 and a decoder IC3 which together comprise a circuit for indentifying the time period during which a given note in the desired chime tune is sounded. The beat generator 17 includes resistors R9, R11, R12 and R14, capacitor C3 and transistors Q1 and Q2 which produce beat pulses at its output 20 at a selectable rate which corresponds to the note rate in the desired chime tune. The beat generator circuit elements are configured in a well known transistorized unijunction (TU) oscillator configuration which is turned on whenever the voltage on the line 16 is approximately ground potential i.e., either the first or second switch latch is set causing the transistors Q1 and Q2 to become properly biased to make the circuit oscillate. When neither the first nor the second switch latch is set, the voltage on the line 16 rises as it is series connected to the +5 volt supply via resistors R12 and R14 and the TU oscillator turns off as transistors Q1 and Q2 are no longer properly biased to cause oscillations. Once turned on, the beat generator 17 produces a negative going pulse with a short duty cycle at its output 20 at a frequency determined by the RC time constant of resistors R9, R11 and capacitor C3, the magnitudes of which are selected so that pulses are produced at 20 at the same rate as notes in the desired chime tune. Typical values for R9, R11 and C3 are shown below in Table 1. Since resistor R9 is adjustable, the RC time constant can be varied by changing its resistance and, consequently, the rate of the negative going beat pusles at 20 is adjustable to coincide with the rate of notes in any desired chime tune.

Connected to the output 20 of the beat generator 17 is a pulse inverter circuit comprised of resistors R13, R15, and a transistor Q3. Transistor Q3 is normally on as the base/emitter junction is normally forward biased by the voltage across R15 which is applied to the base of Q3 and caused by current from the +5 volt supply through the series connected resistors R12, R13, and R15 to ground. However, when a pulse, i.e., a low voltage, appears at the output 20 of the beat generator 17, the voltage at the output 20 is low enough that transistor Q3 turns off causing the voltage at its collector to go high and remain high for the duration of the pulse appearing at 20. As such, positive pulses, referred to as beat pulses, are produced at the collector of Q3 at an adjustable rate which is equal to the rate of notes in the desired chime tune.

The positive pulses appearing at the collector of Q3 are connected by a line 22 to the pulse input (pin 14) of a pulse counter IC2. For the particular pulse counter IC2 identified in Table 1, the counter IC2 is actuated to count pulses on the line 22 whenever the voltage at both pin 2 and pin 3 is low which occurs when either the first or the second switch latch is set.

For the particular pulse counter IC2 identified in Table 1, output pins 1 and 12 are wired together to form one common output line 12'. This common output line 12' together with the lines connected to pins 9, 8 and 11 of IC2 comprise the output lines of the pulse counter circuit 18 and the voltage on these lines comprises a binary representation of the total number of pulses on line 22 counted by IC2 following its being turned on by a low voltage at pins 2 and 3. Those skilled in the art will recognize that different controllable pulse counters can be used in place of the particular circuit in Table 1 for IC2 and, consequently, the circuit wiring may be somewhat different for the modified pulse counter 18 than shown in the drawing.

The binary output signal from each output pin, namely pins 1 and 12 (12'), pin 9, pin 8 and pin 11, of IC2 is respectively connected to an input pin 23, 22, 21, 20 of a 4 to 16 decoder IC3. For the particular decoder IC3 shown in Table 1, it is operative whenever the voltage at both pin 18 and pin 19 is low to decode the binary input on pins 23, 22, 21, 20 and produce a low voltage signal on a unique one of its output pins (pin 1, 2, 3, 4, 5, 6, 7, 8, 9, 10, 11, 13, 14, 15, 16 or 17).

In operation, the beat generator 17, the pulse counter 18 and the decoder IC3 operate together to produce a low voltage at a unique one of sixteen discrete outputs of IC3 during each time period corresponding to the time period of a note in the desired chime tune. Since only 16 unique outputs of IC3 are available in the exemplary circuit in the drawing, the total number of notes in the desired chime tune is limited to a maximum of 16. Fewer notes may be sounded in the desired chime tune as the circuit of the invention may skip a beat or pause during the chime tune in a manner described in detail later. If a counter of larger capacity than 16 were substituted for IC2 and a decoder capable of decoding more than 16 unique inputs were substituted for IC3 then the number of notes in the desired chime tune can be increased.

Alternatively, other functionally equivalent circuits may be used to perform the function of the beat generator 17, the pulse counter 18 and the decoder IC3. For example, a controllable oscillator, such as the beat generator 17, can be connected to a multi-position shift register with each pulse from the oscillator causing a single bit of data to shift a single register position. The register position in which the data bit is located then indicates the note in the desired chime tune while the oscillator pulse rate determines the length of each note.

Returning again to the exemplary embodiment of the invention in the drawing, the enable circuitry for decoder IC3 prevents the changing of the pulse count in IC2 from actuating an improper output line. To accomplish this, both actuating pins 18 and 19 are utilized. Pin 19 connects to line 16 which is low whenever either the first or the second switch latch is set. Pin 18, however, connects to line 22 which goes high every time the counter IC2 is incremented thereby disabling the decoder IC3 at the very instant of time that the counter IC2 changes. By the time the voltage on the wire 22 goes low again, the output of IC2 has stabilized at the new pulse count and the decoder IC3 is enabled again to place a low voltage on its output pin corresponding to the pulse count in IC2.

The output pins of the decoder IC3 connect via respective diodes D3–D18 to terminal points indicated by a double headed arrow such as that shown at 23. Each terminal point may be connected by a programming line or jumper, such as 24, to a terminal plug indicated as a ball, such as 25, which is electrically connected to the junction point between two resistors (or end of resistor string) of a resistor ladder network comprised of resistors R31–R43. As will be more evident later, each jumper 24 connects between a terminal pin such as 23 which identifies the numerical position of the note in the chime tune and a terminal plug such as 25 which identifies the tone to be generated for that note. Should a pause or skipped beat be desired in the chime tune, a jumper 24 is not connected to the terminal pin whose voltage goes low during the corresponding time period in the chime tune. Consequently, a low voltage is not applied to any terminal plug 25 during the time period in the desired chime tune corresponding to the skipped beat.

The door chime of the invention includes a tone generating oscillator 30 which includes transistors Q7, Q8, resistors R17, R18, R19, R45, the ladder resistors R31–43 and a capacitor C8 which are connected in the well known transistorized unijunction (TU) oscillator configuration. The tone generating oscillator 30 is normally off, i.e., no pulses are produced at the collector of Q7, so long as all of the output pins of the decoder IC3 are high because this condition raises the voltage at the emitter of Q8 thereby preventing either transistor Q7 and Q8 from conducting. When any output pin of IC3 is low, this low voltage is transferred from the IC3 output pin via the connected jumper to a terminal plug connected to a resistor in the ladder. This causes the tone generating oscillator 30 to turn on because the voltage at the emitter of transistor Q8 goes sufficiently low to cause transistors Q7 and Q8 to conduct in the manner well known for TU oscillators. Consequently, a string of pulses is produced at the collector of transistor Q7 which is coupled to the base of transistor Q6 causing it to turn on and off and produce a string of negative going pulses at its collector. The frequency of the pulses generated by the tone generating oscillator 30 is controlled by the RC time constant of the capacitor C8 and the total series resistance between the emitter of transistor Q8 and the low voltage provided by the active output of the decoder IC3. Since the total resistance in series with the emitter of Q8 includes a variable pitch adjusting resistor R45, the frequency of the oscillator 30 can be adjusted somewhat by changing R45 to raise or lower the frequency of pulses at the base of Q6. This allows the pitch of all notes produced by the chimes of the invention to be simultaneously shifted up or down depending on which direction R45 is adjusted to make the interval between notes match the musical scale.

The tone pulses generated at the collector of transistor Q6 are at a frequency which is related to and higher than any frequency in the audio note generated by the chime of the invention. The reason for this is a matter of convenience. Since each audio note of the chime should contain a plurality of harmonically related sinusoidal components in order to sound pleasing to the user, means must be provided to produce the necessary harmonically related sinusoidal components. In digital logic of the type used in the exemplary embodiment of the invention, pulse signals at harmonically related frequencies are easily produced by using pulse counters, such as IC4, which can easily produce an output pulse for every 2, 4, 8, etc., input pulses. When IC4 is operating, it produces square wave pulses at its output pins 9, 8, and 11 which respectively have a pulse rate at $\frac{1}{2}$, $\frac{1}{4}$ and $\frac{1}{8}$ the pulse rate at its input pins 1 and 14 which are wired together and connected to the collector of transistor Q6 by a line 31. Alternatively, a frequency multiplying circuit might be used in place of IC4 to produce a plurality of harmonically related signals from the pulse signal at the collector of Q6.

The square wave signals at IC4 output pins 8, 9, 11 are respectively coupled via resistors R24, R25, R26, to a wave shaping filter 36 comprised of a resistor R27 and two capacitors C5 and C6. The magnitudes of resistors R24, R25 and R26 control respectively the amplitude of the square wave signals at $\frac{1}{8}$, $\frac{1}{2}$, and $\frac{1}{4}$ the frequency of pulses on line 31. The magnitude of each resistor R24, R25 and R26 is selected so that the tone produced is pleasing to the user. The wave shaping filter 36 converts the square wave signals coupled via resistors R24, R25 and R26 from output pins 11, 9, 8 of IC4 into a signal having sinusoidal components at $\frac{1}{2}$, $\frac{1}{4}$ and $\frac{1}{8}$ of the frequency of pulses appearing on line 31. The component values for R27, C5 and C6 are selected so that the signal coupled via C7 to the volume control resistor R28 comprises a complex wave with three substantially sinusoidal components.

The signal appearing at the wiper 40 of the volume control resistor R28 is connected to an input (pin 7) of an integrated circuit audio amplifier IC5. The output of the audio amplifier IC5 connects to a speaker 35 and the volume of the sound reproduced thereby is controlled by the position of the wiper 40.

The counter IC4 has another output at pin 12 which comprises a square wave at one half the input frequency of pulses appearing on line 31. This square wave is coupled via a resistor R21, an adjustable decay resistor R22 and a diode D19 to a capacitor C4. Whenever the voltage at output pin 12 of IC4 is high, above +0.6 volts in the illustrative embodiment, a charging current passes through R21, R22, and D19 to charge the capacitor C4. As the voltage builds up on capacitor C4, the base emitter junction of transistor Q5 becomes increasingly forward biased causing it to be increasingly conductive. Since the collector of Q5 connects to the input of the wave shaping filter 36, the amplitude of the signal applied thereto gradually decreases as the transistor Q5 is turned on by the gradual charging of C4. As such, the amplitude of the note coupled by the capacitor C7 to the volume control resistor R28, decays gradually. The rate at which the amplitude decays, however, is controlled by the adjustment of R22 which, in combination with resistor R21, controls the charging rate of capacitor C4. Consequently, diode D19, transistor Q5, resistors R21, R22, and capacitor C4 are operative to cause each note in the desired chime tune to gradually decay in amplitude and the rate of decay is adjustable to suit user preference via changing R22.

A reset circuit including a reset transistor Q4 is provided and has its collector wired to the positive terminal of capacitor C4 and its emitter wired to ground. The base is coupled via a resistor R16 to the line 22 and whenever a pulse of amplitude above +0.6 volts appears thereon, transistor Q4 conducts. Consequently, during each beat pulse generated by the beat generator 17 when the voltage on line 22 is above +0.6 volts, the transistor Q4 is turned on thereby shorting the capacitor C4 to ground thus resetting the decay circuit.

The chime according to the invention automatically turns itself off following the last note in the desired chime tune. This is accomplished by resetting the switch latch which was set initially by the momentary closing of either switch 10 or 11. The first switch latch which is set whenever switch 10 is momentarily closed is reset by a reset signal appearing on line 42 which connects to output pin 17 of the decoder IC3. The voltage on pin 17 goes low, i.e., to near ground potential, during the time period corresponding to the sixteenth beat in the desired chime tune. Since the line 42 couples to input pin 7 of a non-inverting buffer IC1C, the voltage at its output pin 8 is low whenever the voltage at pin 17 of decoder IC3 is low. However, when the 16th beat in the desired chime tune is completed, the voltage at pin 17 rises thereby causing the voltage at the output pin 8 of IC1C to rise also. This rising voltage at pin 8 of IC1C is coupled via a coupling capacitor C1 in the form of a positive pulse to the input pin 5 of the non-inverting buffer IC1A. This positive pulse causes the "latch" including IC1A to reset because the positive voltage at pin 5 causes the voltage at pin 6 to go positive. The positive voltage at pin 6 is fed back to pin 5 via resistor R3 thereby maintaining pin 5 at a positive potential which is the reset condition for the first switch latch. This causes a positive voltage to appear at the output pin 10 the non-inverting buffer IC1B. As the result, the voltage at the emitter of Q2 goes high thereby causing the beat generator to turn off. Likewise, when the voltage goes high at pins 2 and 3 of IC2 and pin 19 of IC3, the pulse counter IC2 and the decoder IC3 are disabled thereby preventing further operation of the chime and counter IC2 is also reset to a zero count.

A separate reset circuit is provided to reset the second switch latch after it becomes set due to momentary closure of switch 11. The second reset circuit includes a second reset line 44, one end of which connects to the input pin 1 of a non-inverting buffer IC1F whose output (pin 2) is coupled via a capacitor C2 to the input (pin 3) of the non-inverting buffer IC1D in the second switch latch. The other end of the reset line 44 is connected to a selected one of the output pins (pin 1–11, 13–17) of the 4 to 16 decoder IC3. Whenever the output pin connected to the line 44 goes low, a low voltage is applied to pin 2 of the non-inverting buffer IC1F. At the conclusion of the note in the desired chime tune during which the output pin of IC3 connected to line 44 goes low, the voltage at pin 1 and pin 2 of IC1F goes from a low to a high level which is coupled by capacitor C2 to input pin 3 of IC1D in the second switch latch. This causes the output pin 4 of IC1D to go high which is coupled back to the input pin 3 of IC1D via resistor R4 causing the second switch latch to be reset. As such, the voltage at pin 4 of IC1D remains at a high level and this high level is transmitted via the non-inverting buffer IC1F to the line 16 causing the beat generator 17 to turn off and the pulse counter IC2 to be disabled thereby preventing further outputs of the decoder IC3 from going low until either switch 10 or 11 is subsequently momentarily closed.

The selected output pin of decoder IC3 to which the reset line 44 connects is chosen by the user. Should the user desire to be able to identify which switch, 10 or 11 actuated the chime, then the line 44 should be connected to an output pin of the decoder IC3 other than pin 17. In this manner, the desired chime tune is 16 notes long if actuated by switch 10 but less than 16 notes long if actuated by switch 11. For ease of identification, the line 44 should be connected to an output pin of IC3 which is low during note in the desired chime tune which is significantly different from the 16th note. This causes the chime tune to be truncated at an easily identifiable note in the desired chime tune if it is actuated by switch 11 thereby making it possible to determine which switch (10 or 11) actuated the chime from the number of notes sounded in the desired chime tune.

The components listed in Table I have been found to be particularly advantageous when utilized in the illustrated embodiment of the invention. Those of skill in the art, however, will recognize that the circuit can be optimized for similar and other applications of the invention by substituting components of different values from those shown in TABLE I.

TABLE I

| | | | |
|---|---|---|---|
| | | C1, C2, C5, | |
| R1, R2 | 680 ohm | C6, C7, C8 | 0.1uF |
| R3, R4, R5, R17 | 270 ohm | C11 | 680pF |
| R7, R8, R13, | | | |
| R15, R25 | 15k ohm | C13 | .1uF |
| R11 | 150k ohm | C3, C4 | .68uF |
| R12, R16 | 1000 ohm | C9 | 10uF |
| R18 | 27 ohm | C12 | 50uF |
| R19, R29 | 150 ohm | | |
| R21, R31 | 27k ohm | | |
| R14, R32 | 3.3k ohm | D1–D19 | IN4149 |
| R23, R26 | 330k ohm | | |
| | | | 2N2141 |
| R27 | 47k ohm | Q1, Q7 | |
| | | Q2, Q3, | |
| R24 | 1M ohm | Q4, Q5 | MPSA20 |
| R33, R34 | 3.6k ohm | Q6, Q8 | |
| R35, R36 | 3.9k ohm | | |
| | 4.3k ohm | IC1A, B, | |
| R37 | | C,D,E,F | SN7417N IC |
| R38, R39 | 4.7k ohm | IC2, IC4 | SN7493AN IC |
| R41 | 5.1k ohm | IC3 | SN74154 IC |
| R42, R43 | 5.6k ohm | IC5 | TBA820L IC |
| R44 | 6.2k ohm | | |
| R9 | 2 M ohm | | |
| R22 | 500k ohm | | |
| R45 | 50k ohm | | |
| R28 | 100k ohm | | |

It will also be evident to those of skill in the art that the chimes of the invention can be actuated by more than two different switches. In order to accomplish this result, the illustrated circuit need only include an additional switch and three non-inverting buffers wired as shown for switch 10 and buffers IC1A, IC1B and IC1C. The reset line corresponding to line 42, however, is advantageously connected to a different output pin of decoder IC3 from those connected to either line 42 or 44 so that closure of the additional switch can be identified by the number of notes sounded in the desired chime tune.

These and other modifications will be readily apparent to those of skill in the art and can be made without departing from the spirit and scope of the invention as defined in the following claims.

What is claimed is:

1. A programmable electronic door chime comprising:

means for generating an actuating signal;

resettable circuit means responsive to said actuating signal for generating a first signal;

identification circuit means, having a plurality of output terminals, responsive to said first signal to generate a series of clock pulse signals for sequentially energizing said plurality of output terminals, a selected one of said output terminals being connected to said resettable circuit for providing a reset signal thereto when said selected terminal is energized to terminate said first signal; and an RC controlled tone generator, for producing output tone signals comprising, in combination, a multivibrator, a capacitance element and a plurality of series connected resistance elements, said generator having a plurality of different tone determining inputs, each comprising a junction point between a different pair of said series connected resistance elements for selective connection to said output terminals and for varying the RC constant controlling said multivibrator to generate a desired sequence of output tone signals in direct response to said clock pulse signals energizing the ones of said terminals connected to said tone determining inputs.

2. The programmable electronic chime of claim 1 wherein said tone generator includes a common pitch adjustment means for adjusting the pitch of all tones generated thereby.

3. The programmable electronic chime of claim 1 wherein said tone generator includes an adjustable tone decay circuit for reducing output tone signal amplitude during the time period each tone is generated.

4. The programmable electronic chime of claim 1 wherein said tone generator includes means to produce a plurality of component tone signals in response to each tone-determining input and additionally includes a wave shaping means for combining weighted versions of said component tone signals to produce said output tone signals.

5. The programmable electronic chime of claim 4 wherein said tone generator additionally includes an adjustable decay circuit for reducing the amplitude of said output tone signals during the time period corresponding to each said clock pulse.

6. A programmable electronic door chime comprising:

a plurality of means for generating an actuating signal;

a plurality of resettable circuit means each uniquely associated with one of said means for generating and each responsive to said actuating signal to generate a first signal;

identification circuit means, having a plurality of output terminals, responsive to said first signal to generate a series of clock pulse signals for sequentially energizing said plurality of output termnals, selected output terminals being connected to each of said resettable circuits for providing reset signals thereto for terminating said first signal; and an RC controlled tone generator, for producing output tone signals comprising, in combination, a multivibrator, a capacitance element and a plurality of series connected resistance elements, said generator having a plurality of different tone determining inputs, each comprising a junction point between a different pair of said series connected resistance elements for selective connection to said output terminals and for varying the RC constant controlling said multivibrator to generate a desired sequence of output tone signals in direct response to said clock pulse signals energizing the ones of said terminals connected to said tone determining inputs.

7. The programmable electronic chime of claim 6 wherein said selected output terminals are connected to different resettable circuit means so that the chime ends after a selective number of tones in the desired sequence have sounded depending on the particular means for generating used to actuate the chime.

8. A programmable electronic chime comprising, in combination:

at least one actuator for producing an actuation signal;

a resettable circuit means coupled to each actuator and set by said actuation signal therefrom to provide a set signal;

a beat pulse generator responsive to a set signal to provide a string of beat pulses;

a beat pulse identifying circuit having a plurality of output terminals responsive to said beat pulses to produce a clock pulse signal with successive pulses appearing at respective ones of said output terminals, a selected one of said output terminals being connected to each resettable circuit means for resetting same;

an RC controlled tone generator, for producing output tone signals comprising, in combination, a multivibrator, a capacitance element and a plurality of series connected resistance elements, said generator having a plurality of different tone determining inputs, each comprising a junction point between a different pair of said series connected resistance elements for selective connection to said output terminals and for varying the RC constant controlling said multivibrator to generate a desired sequence of output tone signals in direct response to said clock pulse signals energizing the ones of said terminals connected to said tone determining inputs.

* * * * *